US009108457B2

(12) United States Patent
Ohashi et al.

(10) Patent No.: US 9,108,457 B2
(45) Date of Patent: Aug. 18, 2015

(54) DISPENSER WITH TRANSFER HEAD

(75) Inventors: Takashi Ohashi, Osaka (JP); Hideto Shima, Kyoto (JP)

(73) Assignee: KOKUYO CO., LTD., Osaka (JP)

( * ) Notice: Subject to any disclaimer, the term of this patent is extended or adjusted under 35 U.S.C. 154(b) by 328 days.

(21) Appl. No.: 13/122,288

(22) PCT Filed: Sep. 14, 2009

(86) PCT No.: PCT/JP2009/065995

§ 371 (c)(1),
(2), (4) Date: Apr. 1, 2011

(87) PCT Pub. No.: WO2010/038604

PCT Pub. Date: Apr. 8, 2010

(65) Prior Publication Data

US 2011/0180217 A1 Jul. 28, 2011

(30) Foreign Application Priority Data

Oct. 2, 2008 (JP) ..... 2008-257531

(51) Int. Cl.
*B32B 37/26* (2006.01)
*B43L 19/00* (2006.01)
(Continued)

(52) U.S. Cl.
CPC ..... *B43L 19/0068* (2013.01); *B65H 37/007* (2013.01); *Y10T 156/17* (2015.01)

(58) Field of Classification Search
CPC ..... B65H 37/007; B43L 19/0068
USPC ..... 156/523, 527, 538, 540, 574, 577, 579; 118/76, 200, 257; 225/46; 242/160.2, 242/160.4, 170, 171, 588, 588.2, 588.3, 242/588.6; 206/411
See application file for complete search history.

(56) References Cited

U.S. PATENT DOCUMENTS 4,391,014 A * 7/1983 Pitzen ..... 15/231
7,766,066 B2 * 8/2010 Hyodo ..... 156/577
(Continued)

FOREIGN PATENT DOCUMENTS

JP 06055895 3/1994
JP 2002264588 9/2002
(Continued)

OTHER PUBLICATIONS

ISR for PCT/JP2009/065995 mailed Nov. 17, 2009.

*Primary Examiner* — Mark A Osele
(74) *Attorney, Agent, or Firm* — Lowe Hauptman & Ham, LLP

(57) ABSTRACT

A dispenser with a transfer head includes a feeding roller placed within a case provided with an opening, and supporting a transfer tape T so as to be capable of being fed; a take-up roller for taking up a base material tape that has been used to transfer; a transfer roller for transferring a transfer agent; an interlocking mechanism for rotating the feeding roller and the take-up roller in an interlocking manner; a holding member provided on the opening side in a front/back direction so as to be capable of moving forward and backward; and a rotational frame for supporting the feeding roller, the take-up roller and the transfer roller, wherein when a pressing force is applied to the case while the holding member abuts against a surface to be transferred P, the transfer head is relatively projected, and moved on the surface P with pressing thereto so that the transfer agent can be transferred.

2 Claims, 19 Drawing Sheets

(51) Int. Cl.
*B26F 3/02* (2006.01)
*B65H 37/00* (2006.01)

(56) References Cited

U.S. PATENT DOCUMENTS

2008/0223511 A1* 9/2008 Schumacher et al. ..... 156/230
2009/0050275 A1 2/2009 Sakanishi

FOREIGN PATENT DOCUMENTS

JP 2007203691 A * 8/2007
JP 3137300 U 11/2007
WO 00-47506 A1 8/2000

* cited by examiner

DISPENSER WITH TRANSFER HEAD

RELATED APPLICATIONS

The present application is national phase of PCT/JP2009/065995 filed on Sep. 14, 2009 and claims priority from Japanese Application Number 2008-257531, filed Oct. 2, 2008.

TECHNICAL FIELD

The present invention relates to a dispenser with a transfer head, and more particularly, to a dispenser with a transfer head capable of transferring a transfer agent in the same manner as stamping by using a rubber stamp, and transferring it continuously along a surface to be transferred, the transfer agent being provided on a band-like base material tape.

BACKGROUND ART

Dispensers with a transfer head are known which are provided with a transfer tape so as to be capable of being fed and taken-up, the transfer tape providing with an adhesive or a coating film for correction on a band-like base material tape, and configured to place the transfer head including a transfer roller and the like on its feeding path, wherein the dispensers with a transfer head may transfer a transfer agent by a predetermined operation with the transfer head pressed on a paper surface.

There are the following aspects in which the transfer agent is transferred on a paper surface: in one aspect, the transfer head is moved along a paper surface while pressed on the paper surface to perform a transfer along the direction of such movement; and in another aspect, the transfer head is pressed on a paper surface in the same manner as stamping to partially perform a transfer. Patent Document 1 discloses the dispenser whose aspect may be selected from these aspects.

[Patent Document 1] Japanese Patent Application Laid-Open No. 2007-203691

SUMMARY OF THE INVENTION

Problems to be Solved by the Invention

However, the dispenser disclosed in Patent Document 1 has a configuration in which the transfer agent is only transferred in a spot shape when the latter aspect is selected. This is due to no movement of the transfer head alone the surface when the surface is pressed by a tip side of the transfer head. Therefore, such dispenser has a disadvantage that it is unsuitable for the adhesive to be discontinuously transferred by a certain length when, for example, an adhesive is applied as a transfer agent.

Object of the Invention

The present invention is made in view of such disadvantage, and has its object to provide an appropriate dispenser with a transfer head not only to allow for transferring a transfer agent into a band shape along the surface, but also to transfer the transfer agent by a given length.

Means to Solve the Problems

In order to achieve the above-described objects, the present invention has the following configuration: a dispenser with a transfer head, comprising: a case provided with an opening in a fore part of the case through which a transfer head faces the outside, a feeding roller placed within the case and supporting a transfer tape so as to be capable of being fed, the transfer tape being provided with a transfer agent on a band-like base material tape, a take-up roller for taking up the base material tape, and an interlocking mechanism for rotating the feeding roller and the take-up roller in an interlocking manner, the transfer agent being provided so as to be capable of being transferred via the transfer head; wherein the dispenser is provided with a holding member provided on the opening side of the case so as to be capable of moving forward and backward in a front/back direction, and normally maintaining a front end thereof at a position projecting from the transfer head; and when a pressing force is applied to the case in a state of where the front end of the holding member abuts against a surface to be transferred, the transfer head is relatively projected, and moved or traveled along the surface with pressing thereto so that the transfer agent can be transferred to the surface.

The present invention preferably has the following configuration: the dispenser includes a main frame provided within the case movably in the front/back direction of the case, and a rotational frame combined rotatably relative to the main frame, and the feeding roller, the transfer head, and the take-up roller are provided rotatably in a direction permitting the movement of the transfer head via the rotational frame.

Moreover, the main frame has a configuration that it comprises a first spring and a second spring having a stronger spring force than the first spring on a front and a back end sides, respectively, the first spring applying a force to the holding member in the direction projecting from the opening, and the second spring applying a force forward to the main frame, wherein the main frame moves backward while overcoming the force of the second spring by a force reactive to the pressing force after the transfer head abuts against the surface, so that the rotation center of the rotational frame is displaced backward to cause the transfer head to be moved along and parallel to the surface.

Further, the feeding roller, the transfer head, and the take-up roller may be configured to be respectively supported by a refill plate to configure a single cartridge, and the cartridge is removably provided on the rotational frame so that a used transfer tape may replaced with a new transfer tape.

Moreover, the dispenser has a configuration that it further comprises regulating means for maintaining a rotational direction of the rotary plate in one direction when the transfer head is pressed on the surface.

Moreover, the regulating means is configured to comprise any one of a recess or a convex portion provided at a position distant from the rotation center of the rotary plate, and the other of the recess or the convex portion provided on an inner surface of the case, the recess and the convex portion being provided engageably and rotatably relative to each other, wherein, the rotational direction of the rotary plate is regulated at the engagement portion as a supporting point when the rotation center of the rotary plate moves backward.

Further, the holding member has a configuration that it is rotatably provided between a first position at which the transfer head is surrounded and a second position at which the surrounding is removed, and a continuous transfer along the surface may be performed when the holding member is in the second position. In this case, preferably, a slip preventing member is mounted on a tip side of the holding member.

Moreover, the dispenser may have a configuration that it comprises a slide member movable in the front/back direction within the case near the opening, the holding member being supported by the slide member.

Further, the slide member may be configured to comprise a closed loop-shaped recess, and on the other hand the rotary plate is provided with a convex portion, the convex portion being normally located in place within the recess as an initial position, and guided so as to move in one direction within the recess to return to the initial position when the rotary plate is rotated.

Moreover, the case, preferably, has a configuration that it is a substantially rectangular parallelepiped, and configured into a shape with the opening positioned on one end side in its longitudinal direction, and configured to allow the transfer agent to be transferred by substantially the same press operation as stamping by using a rubber stamp.

Effects of the Invention

According to the present invention, when the pressing force is applied while the front end of the holding member abuts against the surface, the holding member is moved backward with the transfer head abutting the surface so that the transfer agent can be transferred. In addition, when the pressing force is applied, the transfer head moves the surface, and therefore the transfer may be performed a length depending on the movement distance. The transfer may be performed which ensures a transferring in large area in comparison with a spot transferring Accordingly, for example, a discontinuous transfer may be performed along a longitudinal direction of a tongue piece when the adhesive is transferred on the tongue piece to seal an opening of an envelope.

Moreover, the rotational frame is rotatably provided on the main frame movable in the front/back direction within the case, and the feeding roller, the transfer head, and the take-up roller may be rotated via the rotational frame. In such a configuration, the feeding roller, the transfer head, and the take-up roller may be rotated with their relative spacing kept constant, so that feeding and taking up may be performed without causing the slack and the like in the transfer tape.

Further, the main frame is moved back within the case to allow the rotation center of the rotational frame to be displaced backward. In such a configuration, the transfer head may be moved along the surface, so that the transfer may be performed at constant length.

Moreover, in the case where the feeding roller, the transfer head, and the take-up roller are configured as the cartridge via the refill plate, the replacement of a transfer tape after used may be easily and quickly performed. In addition, in this case, this also eliminates the need for users to winding the transfer tape.

Further, the rotational direction of the rotary plate is regulated by regulating means, and therefore the transfer head may always be moved to a direction of the transfer, thereby being capable of realizing stable transfer operation.

Moreover, the regulating means is configured by the engagement of the rotary plate and the case, and therefore a structure for regulating the rotational direction of the rotary plate may be simplified.

Further, the holding member is configured such that it may be rotated to the second position at which the surrounding of the transfer head is released. In such a configuration, the transfer agent may be transferred along a band-shaped continuous trace when pulling operation is performed with the transfer head pressed on the surface.

Moreover, in the case where the slip preventing member is mounted on the holding member, the position of the surface may be fixedly maintained.

Further, in the case where the slide member is provided within the case to support the holding member, such configuration eliminates the need for a structure for supporting the holding member to be provided within the case, and does not complicate an opening-side shape of the case.

In addition, by providing the closed loop-shaped recess in the slide member, and by providing the convex portion on the rotary plate, the convex portion being guided into the recess, a movement trace when the rotary plate is rotated may be maintained constantly.

Moreover, the case is provided into the substantially rectangular parallelepiped shape in which the opening is located on one end side in the longitudinal direction, such a shape allows substantially the same press operation as stamping by using a rubber stamp to be performed.

Hereinafter unless otherwise stated, the downward direction in FIG. 1 is referred to as "front" or "fore", and on the other hand the upward direction in FIG. 1 is referred to as "back" or "rear". The left side in FIG. 2 is referred to as "upper", the right side is referred to as "lower". Up-and-down is used for the same meaning as height. Moreover, a horizontal direction in FIG. 1 is referred to as a width direction or a width.

DESCRIPTION OF SYMBOLS

Figure 1:
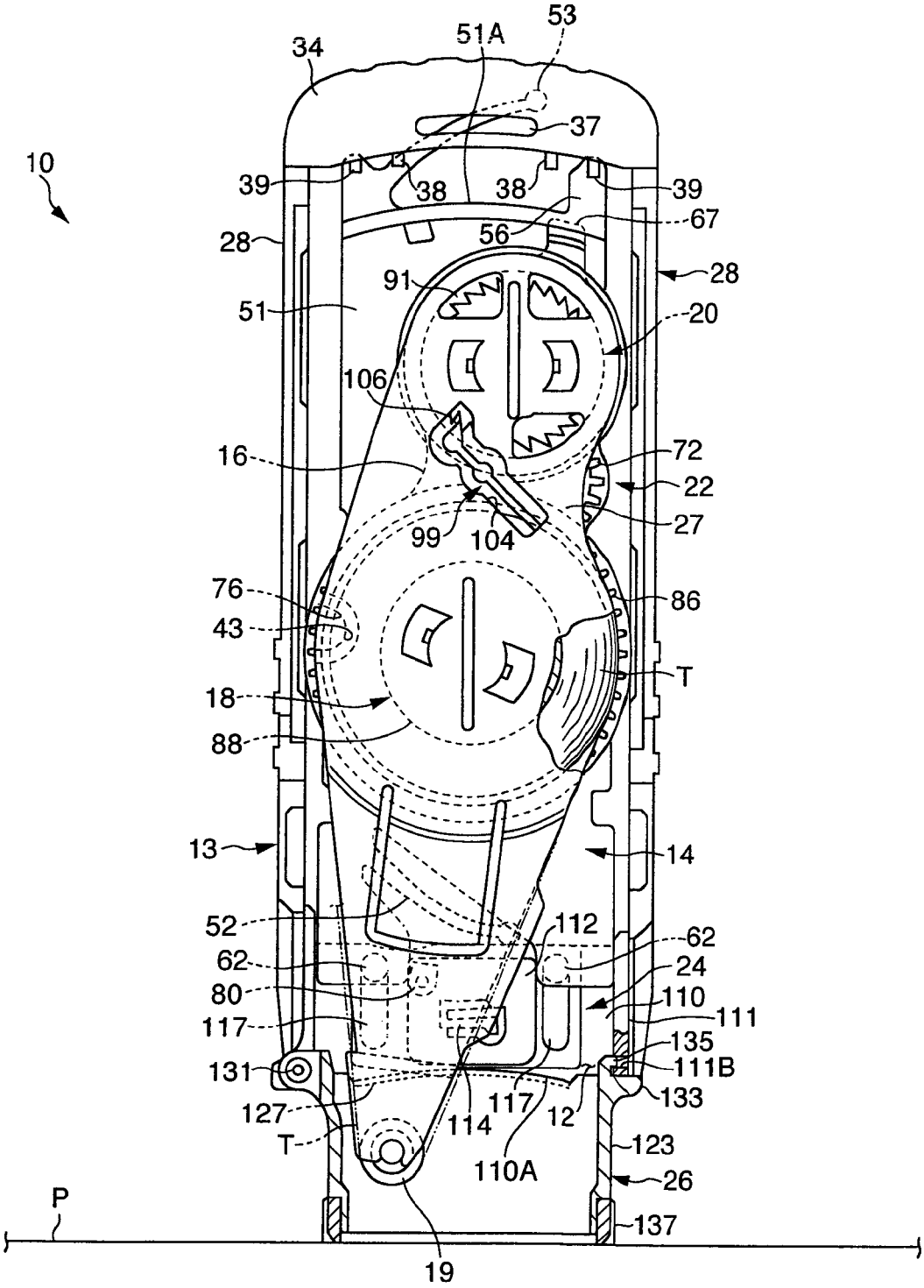
FIG. 1 is a schematic front view showing a dispenser with a transfer head, with its lid body omitted, according to an embodiment.

10 dispenser with a transfer head
12 opening
13 case
14 main frame
16 rotational frame
18 feeding roller
19 transfer roller (transfer head)
20 take-up roller
22 interlocking mechanism
24 slide member
26 holding member
27 refill plate
43 convex portion (regulating means)
52 first spring
53 second spring
69 first supporting body (rotation center)
76 recess (regulating means)
112 recess
114 downward convex portion
137 rubber (slip preventing member)
P surface to be transferred
T transfer tape

Preferred Embodiment For Working The Invention

A preferable embodiment of the present invention will be described in detail below with reference to drawings.

Figure 2:
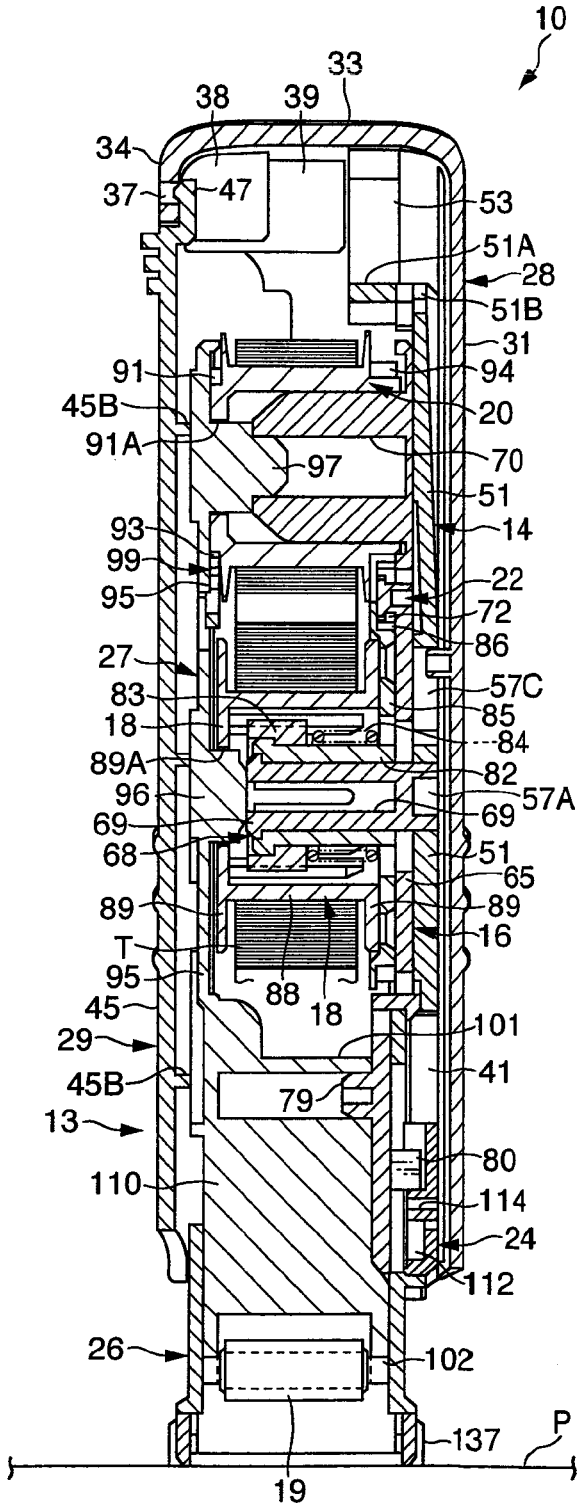
FIG. 2 is a longitudinal sectional view of FIG. 1 with the lid body mounted.

FIG. 1 shows a front view of a dispenser with a transfer head according to the present embodiment with a lid body of the dispenser omitted. FIG. 2 shows a sectional view thereof with the lid body mounted. In these drawings, a dispenser 10 with a transfer head comprises: a case 13 provided with an opening 12 in its fore part; a main frame 14 provided movably in a front/back direction within the case 13; a rotational frame 16 combined rotatably relative to the main frame 14; a feeding roller 18 supporting transfer tape T so as to be capable of being fed, the transfer tape T being provided with a transfer agent on one surface of band-like base material tape; a transfer roller 19 as the transfer head configured to wind the transfer tape T such that the transfer agent is placed on its outer side, and face the outside with the transfer roller 19 located forward of the opening 12; a take-up roller 20 taking up the base material tape after the transfer agent having been transferred via the transfer roller 19; an interlocking mechanism 22 rotating the feeding roller 18 and the take-up roller 20 in an interlocking manner; a slide member 24 provided on the opening 12 side so as to be capable of moving forward and backward in the front/back direction; a holding member 26 connected to the slide member 24 and normally maintaining its front end at a position that is more projecting than the transfer roller 19; and a refill plate 27 supporting the feeding roller 18, the transfer roller 19, and the take-up roller 20 to configure a single cartridge. The transfer agent according to the present embodiment uses an adhesive, the adhesive including configurations in which either it is provided on the entire one surface of base material tape, or many dot-shaped transferring agents are continuously formed along base material tape. Alternatively, the transfer agent may be a coating film for correction, or the like.

The case 13 is composed of a case body 28, and a lid body 29 forming a certain housing space therein in conjunction with the case body 28. The case 13 is generally configured in a substantially rectangular parallelepiped or prism shape. In the present embodiment, the case 13 has, but is not limited to, dimensions of about 80 mm long in the front/back direction, about 20 mm high, and about 30 mm wide, which are dimensions such that an after-mentioned transfer is performed with operational feeling like pressing a rubber stamp with it held in a palm of user's hand.

The case body 28, as also shown in FIGS. 4 to 8, has a substantially rectangular shape as viewed from the top. The case body 28 comprises a bottom wall 31 having a protrusion 31A in a central section of the case body 28, a pair of side walls 32 located on both sides in a width direction (in a vertical direction in FIG. 4) of the bottom wall 31, and a back wall 33 and a back upper wall 34 continuously connected to back ends (right ends in FIG. 4) of the side walls 32 and the bottom wall 31. A fore part of each of the side walls 32 is formed so as to decrease its height in stages. A pair of claw members 36 rising in a piece form is provided on the fore part sides of the side walls 32. On the other hand, a slot-shaped hole 37 is formed in the back upper wall 34, and piece members 38, 39 are provided which extend downward from locations on both upper and lower sides in FIG. 4 of the hole 37. Moreover, guide grooves 41 (see FIG. 8) are formed, each of the guide grooves 41 is in a lower fore part region of each of the side walls 32 and directed in the front/back direction. In a central section in a longitudinal direction of one side wall 32, a convex portion 43 configuring regulating means is provided which is directed in an inward direction of the case body 28. The outer circumference of the convex portion 43 is configured to form a substantially arc-shaped curved surface.

The lid body 29, as also shown in FIGS. 9 to 12, comprises a substantially rectangular shaped planar section 45, a pair of upper side walls 46 continuously connected to both sides in a width direction of the planar section 45, a piece shaped connection 47 provided in a back-end central section of the planar section 45, and recess-shaped sections 49, each of the recess-shaped sections 49 being provided nearer a fore part of each of the upper side walls 46 and directed in the front/back direction. In the lid body 29, the connection 47 is engaged, from below, within the hole 37 provided in the back upper wall 34 of the case body 28, and the claw members 36 is engaged in the recess-shaped sections 49, so that the lid body 29 is combined with the case body 28 to configure the case 13. Grooves 45A (see FIG. 11) extending in the front/back direction are formed in an inner surface on both right and left sides of a fore part of the planar section 45. Parts of the slide member 24 as described below is provided so as to be located in the grooves 45A. Moreover, pluralities of projecting rim sections 45B are provided on an inner surface side of the planar section 45.

Figure 13:
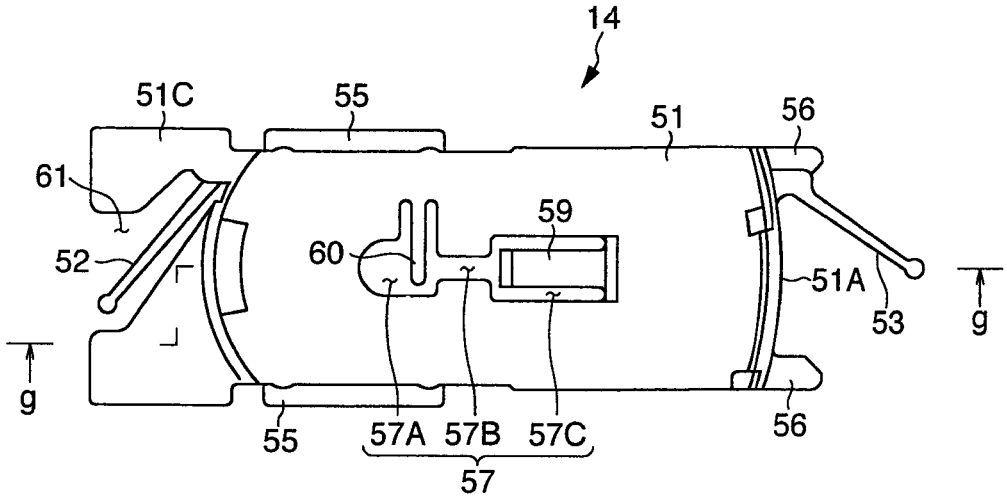
FIG. 13 is a front view of a main frame.
Figure 14:
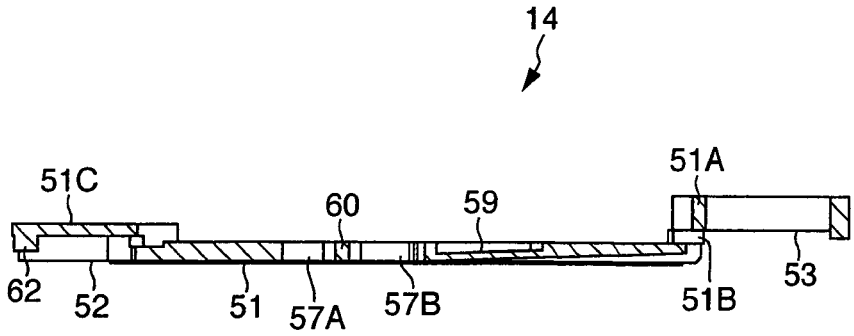
FIG. 14 is a sectional view taken along line g-g of FIG. 13.
Figure 15:
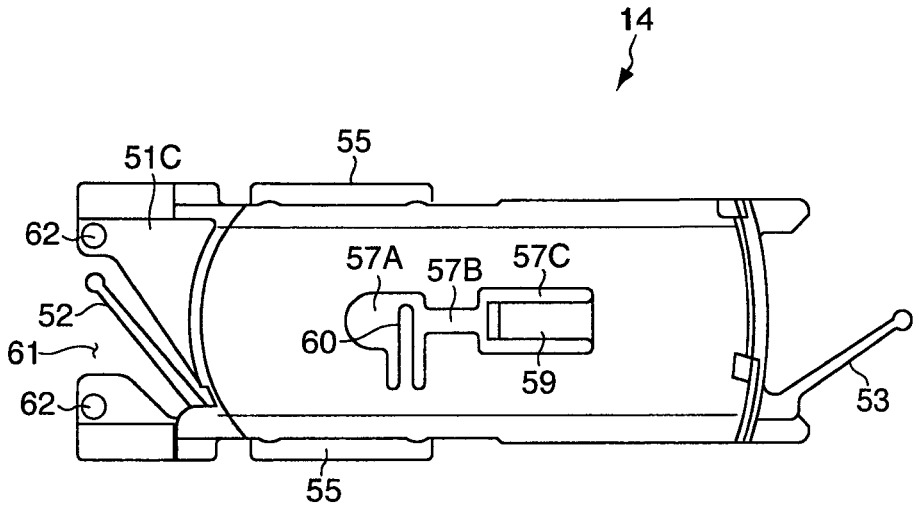
FIG. 15 is a rear view of the main frame.

The main frame 14, as also shown in FIGS. 13 and 14, comprises a plate-shaped section 51 which is a substantially rectangular shape in planar shape, a first spring 52 having a cantilever shape and provided in a tilted direction so as to be directed from one end side in a width direction to the other side in the width direction on a front end side (on a left end side in FIG. 13) of the plate-shaped section 51 whose tip gradually is positioned forward, a second spring 53 having a cantilever shape and provided roughly symmetrically with respect to the first spring 52 via an erect section 51A on a back end side of the plate-shaped section 51, a pair of piece members 55 provided in sections on both sides in the width direction of the plate-shaped section 51 and being elongated in the front/back direction, and protruding members 56 projecting from both sides in the width direction of a back end of the plate-shaped section 51. A punched section 57 is formed in a substantially central section region in a plane of the plate-shaped section 51. The punched section 57 includes a front punched section 57A, and a rear punched section 57C continuously connected to a rear of the front punched section 57A via an intermediate punched section 57B and formed more widely than the intermediate punched section 57B. A piece shaped member 59, whose rear section is continuously connected to the plate-shaped section 51, is made to be located in the rear punched section 57C. Moreover, a transverse member 60 is made to be located within the region of the front punched section 57A, the transverse member 60 being directed to traverse in a width direction thereof. It is noted that the erect section 51A is provided, on its undersurface side, with a slot hole 51B extending in an arc direction.

The plate-shaped section 51 is made to be a raised fore part plate-shaped section 51C in its fore part side, in which a notch section 61 is formed in a tilted direction that is directed from a front-end central section of the fore part plate-shaped section 51C toward a rear section thereof, and the first spring 52 is made to be located within the notch section 61. Each of projections 62 is provided on an undersurface side of a front end section in both ends in the width direction of the fore part plate-shaped section 51C. It is noted that the second spring 52 is adapted to be capable of being deformed or displaced so as to move under an undersurface side of the fore part plate-shaped section 51C. Moreover, the first and second springs 52 and 53 are adapted such that the position shown in FIG. 13 is set to an initial position. The second spring 53 has spring force that is stronger than that of the first spring 52.

Figure 16:
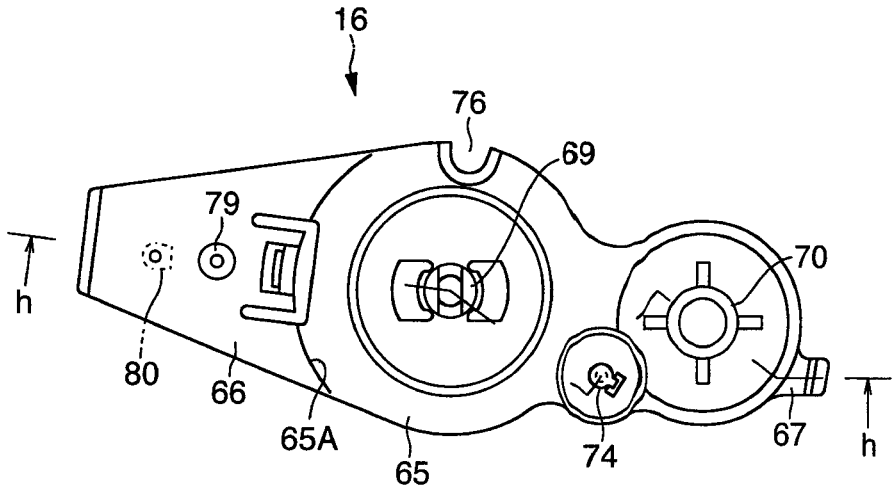
FIG. 16 is a front view of a rotational frame.
Figure 17:
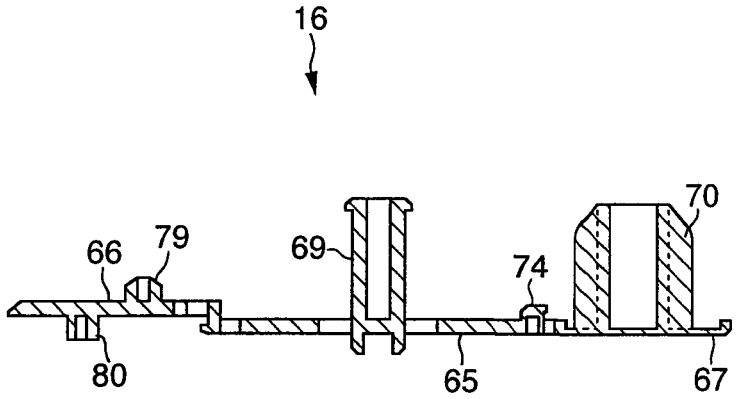
FIG. 17 is a sectional view taken i along line h-h of FIG. 16.

The rotational frame 16, as shown in FIGS. 16 and 17, includes a main body surface 65 whose planar shape is a gourd-like shape, a fore part upper stage surface 66 which is continuously connected to a fore part of the main body surface 65 via a step section 65A and gradually decreases in width toward its tip, and a projection piece section 67 partially projecting from a back end section of the main body surface 65. In a central section of the main body surface 65, a first supporting body 69 is formed which supports a feeding shaft 68 (see FIG. 2) and is the rotation center of the rotational frame 16. In its rear section, a second supporting body 70 is formed which supports the take-up roller 20. A protrusion 74 for supporting an intermediate gear 72 (see FIG. 2) is formed between the first and second supporting bodies 69 and 70, the intermediate gear 72 configuring the interlocking mechanism 22. Moreover, an outer circumferential side section of the main body surface 65 has a recess 76 being substantially arc-shaped notched near the first supporting body 69. The convex portion 43 provided on an inner surface of the side wall 32 of the case body 28 is provided so as to be located in the recess 76. It is noted that the convex portion 43 and the recess 76 configure the regulating means in order to maintain a rotational direction of the rotational frame 16 constant.

A lower end of the first supporting body 69 projects below a lower end of the main body surface 65 such that such projecting section is adapted to be located within the front punched section 57A of the main frame 14.

Moreover, an upward convex portion 79 is provided on a central section upper surface side of the fore part upper stage surface 66. On the other hand, a downward convex portion 80 is provided on an undersurface side thereof forward of the upward convex portion 79.

Figure 18:
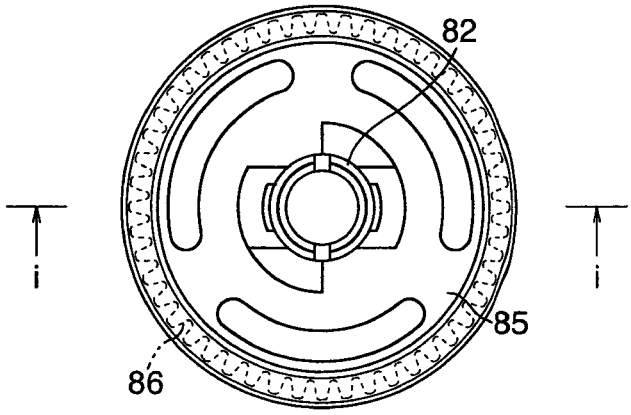
FIG. 18 is a plan view of a cylindrical body configuring a feeding shaft.
Figure 19:
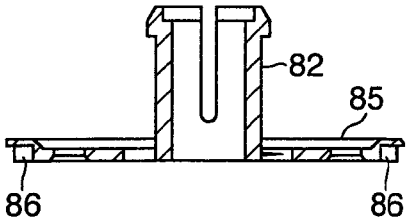
FIG. 19 is a sectional view taken along line i-i of FIG. 18.

The feeding shaft 68, as shown in FIG. 2, includes a cylindrical body 82 mounted rotatably relative to each other on an outer circumferential side of the first supporting body 69 of the rotational frame 16, an annular member 83 located on an outer circumferential side of the cylindrical body 82, and a coil spring 84 for pushing up the annular member 83 upward to maintain the annular member 83 in place. As clearly shown in FIGS. 18 and 19, a lower end of the cylindrical body 82 is integrally provided with a flange section 85 for receiving one end side of the coil spring 84, and a feeding side gear 86 configuring the interlocking mechanism 22 is formed on an outer circumferential side of the flange section 85. It is noted that the annular member 83 is subjected to upward force by the coil spring 84, while an upper inner circumference of the annular member 83 abuts against an upper outer circumference of the first supporting body 69 to prevent it from exiting upward. Moreover, the annular member 83 is formed into a shape having a rib along its axial direction at predetermined intervals along a circumferential direction of its outer circumference surface. The rib is configured to engage an inner circumference surface of the feeding roller 18.

The feeding roller 18, as shown in FIG. 2, includes a cylindrical core section 88 located on an outer circumferential side of the annular member 83, and for winding the transfer tape T into a roll on its outer circumferential side, and reel plates 89 located on both sides in an axial direction of the core section 88. The feeding roller 18 is adapted to be supported by the refill plate 27 by using a hole 89A formed in a central section of the reel plates 89 on the left side in FIG. 2.

Figure 20A:
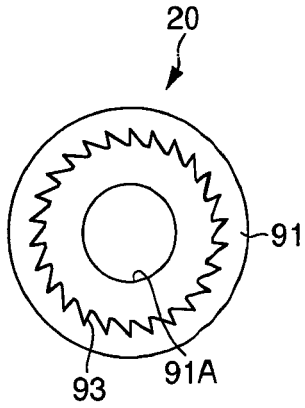
FIG. 20(A) is a front view of a take-up roller.
Figure 20B:
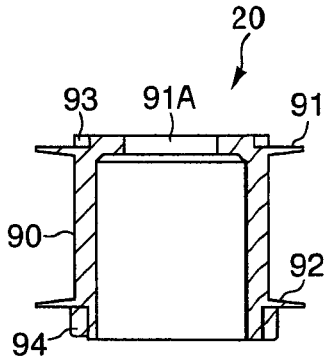
FIG. 20(B) is a sectional view of the take-up roller.
Figure 20C:
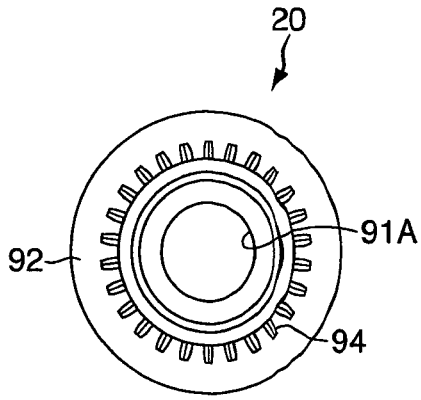
FIG. 20(C) is a rear view of the take-up roller.

The take-up roller 20, as shown in FIGS. 2 and 20, comprises a take-up core 90 mounted rotatably relative to each other on an outer circumferential side of the second supporting body 70, an upper flange 91 located on an upper end side of the take-up core 90, and a lower flange 92 located on a lower end side thereof. A hole 91A for causing the refill plate 27 to support the take-up roller 20, is formed in a central section of the upper flange 91, and a rack 93 configuring a ratchet mechanism is provided along its circumferential direction. Moreover, a take-up side gear 94 configuring the interlocking mechanism 22 is formed on an undersurface side of the lower flange 92.

Figure 21:
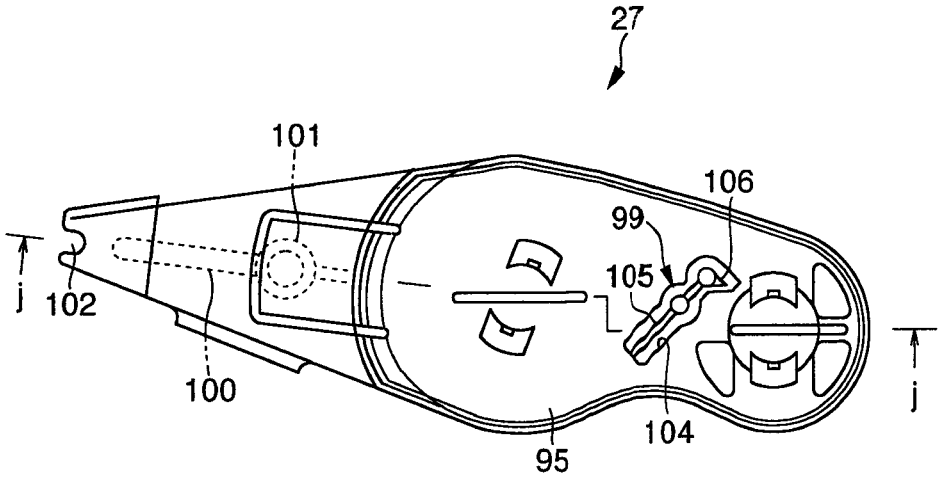
FIG. 21 is a front view of a refill plate.
Figure 22:
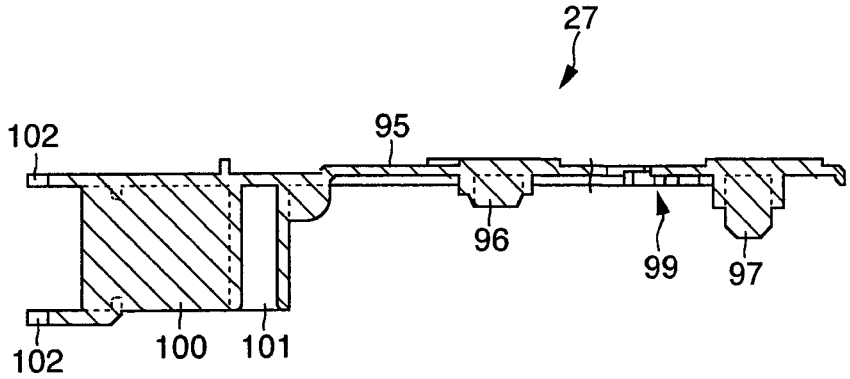
FIG. 22 is a sectional view taken along line j-j of FIG. 21.
Figure 23:
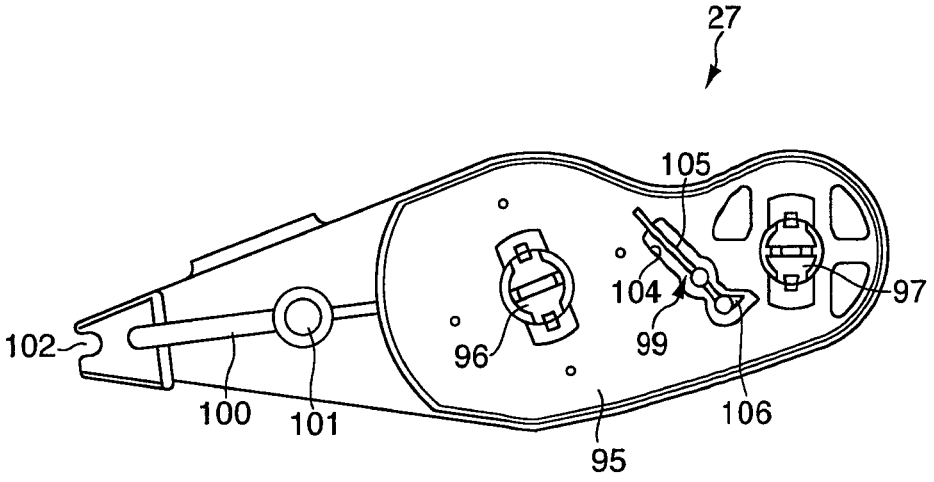
FIG. 23 is a rear view of the refill plate.

The refill plate 27, as also shown in FIGS. 21 to 23, includes a main body plate 95 constituting a planar shape similar to the rotational frame 16. The main body plate 95 comprises a central convex portion 96 provided in a central section thereof, and a rear convex portion 97 provided on a rear section side thereof. A claw member 99 configuring the ratchet mechanism is placed between these convex portions 96 and 97. Moreover, as shown in FIG. 22, a projection piece 100 extending downward is formed in front of the main body plate 95. The projection piece 100 comprises a cylindrical tube 101 formed on a rear section side thereof, and a bearing 102 provided on a fore part side thereof, the bearing 102 rotatably supporting the transfer roller 19.

The claw member 99, as shown in FIG. 21, is located within a slot hole 104 provided in a tilted direction. The claw member 99 is comprised of an arm 105 continuously connected to an undersurface side of the main body plate 95 and extends in a cantilever shape, and a claw 106 provided on a free end side of the arm 105.

Figure 24:
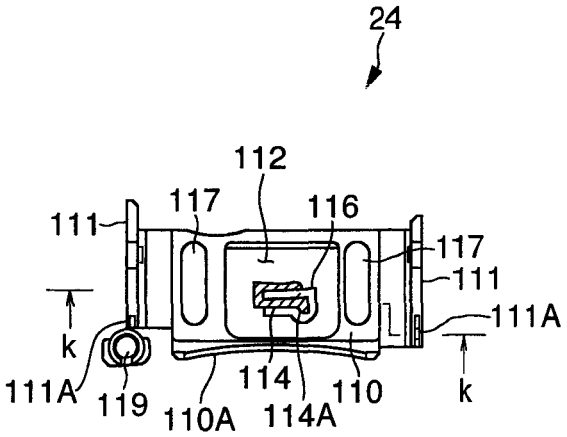
FIG. 24 is a front view of a slide member.
Figure 25:
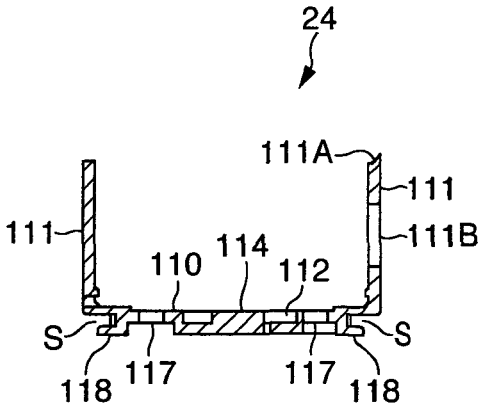
FIG. 25 is a sectional view taken i along line k-k of FIG. 24.
Figure 26:
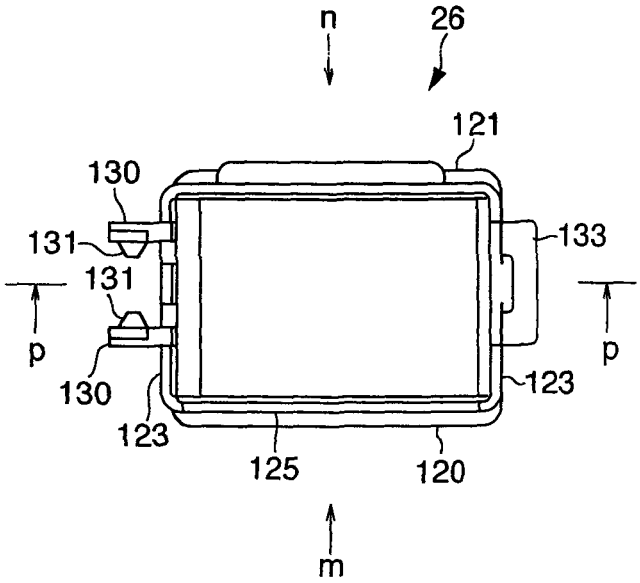
FIG. 26 is a plan view of a holding member.
Figure 27:
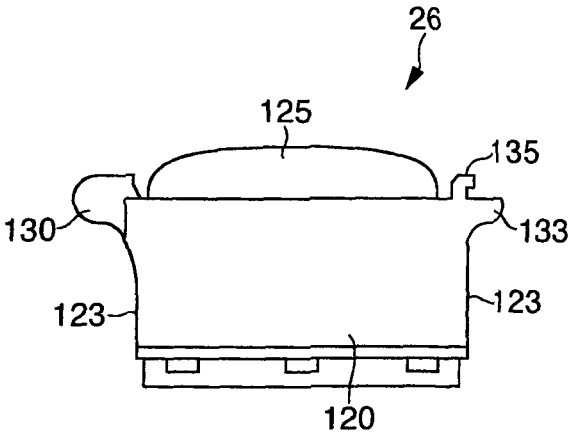
FIG. 27 is a view as viewed from the direction of the arrow m of FIG. 26.
Figure 28:
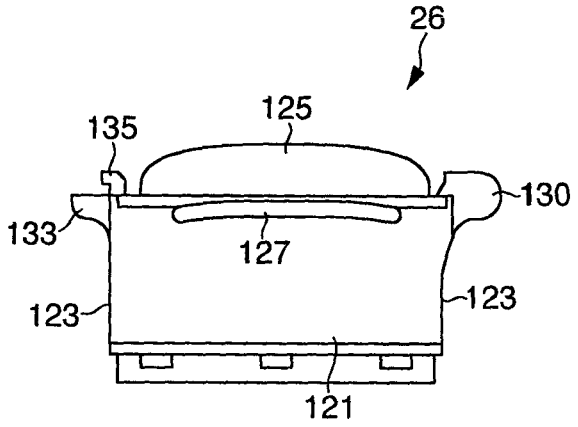
FIG. 28 is a view as viewed from the direction of the arrow n of FIG. 26.
Figure 29:
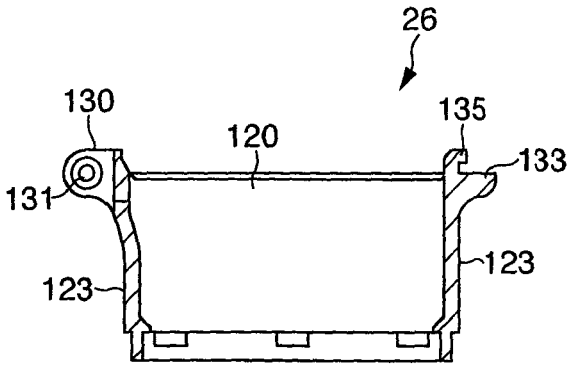
FIG. 29 is a sectional view taken along line p-p of FIG. 26.

The slide member 24 is placed inside the opening 12 in the case 13. The slide member 24, as shown in FIGS. 24 and 25, includes a base surface 110 located on the bottom wall 31 of the case body 28, and a pair of erect surfaces 111 continuously connected to both ends in a width direction of the base surface 110. As viewed from front, the slide member 24 is configured to have an upward substantially U-shape in shape. A central section of the base surface 110 is configured as a recess 112 with an upper surface thereof having a lower height. A central section of the recess 112, as shown in FIG. 24, is provided with a raised guide rib 114 having a substantially U-shape as viewed from the top, the substantially U-shape being directed so as to open a right side thereof, the recess 112 being provided with a closed loop in which a substantially quadrilateral trace is formed. It is noted that, in FIG. 24, for the purpose of facilitating understanding of a planar shape of the guide rib 114, the region of the guide rib 114 is depicted with oblique lines. In the guide rib 114, an end of a portion thereof located in front (below in FIG. 24) is configured to form a tilted section 114A directed to a right lower direction in FIG. 24. Moreover, in the substantially same region as the guide rib 114 as shown with the oblique lines, a section shown with an outline which is directed in a substantially symmetrical direction with respect to the guide rib 114 is a hole 116.

In the base surface 110, slots 117 directed in the front/back are formed on both sides in a width direction of the recess 112 (a horizontal direction in FIG. 24). Moreover, piece shaped sections 118 are formed on both ends in the width direction on an undersurface side of the base surface 110, each of the piece shaped sections 118 forming a gap S between the piece shaped sections 118 and the undersurface of the base surface 110. The piece shaped section 118 is adapted so as to be located within the guide groove 41 provided in the side wall 32 of the case body 28. On the other hand, an acute angle section 111A is formed in an upper end portion of the erect surface 111 of the slide member 24. The acute angle section 111A is received within the groove 45A formed in the planar section 45 of the lid body 29. Thus, the slide member 24 is guided movably in a front/back direction in a stable position within the case 13. Moreover, a curved surface section 110A is formed on a front end side of the base surface 110.

In the erect surfaces 111, an aperture 111B along the vertical direction is formed in the erect surface 111 on the right side in FIG. 24, and on the other hand a bushing 119 is provided in an intermediate section in a height direction in a front end of the erect surface 111 on the left side.

When pressing force is applied to the case 13 in a position in which the front end of the holding member 26 is directed to a surface to be transferred S, the holding member 26 is moved backward so as to cause the transfer roller 19 to relatively project. The holding member 26, as shown in FIGS. 26 to 29, comprises a shape which is substantially rectangular cylindrical shaped as viewed from the top, the shape being capable of surrounding the transfer roller 19. In particular, the holding member 26 includes a front face 120 and a rear face 121 which are provided in substantially parallel to each other, and sides 123 which each are located between end sections of these faces. A rising face 125 is formed on an upper end of the front face 120. On the other hand a bowed rib 127 is formed on an upper section of the rear face 121, the bowed rib 127 being opposed to the curved surface section 110A as previously described. Moreover, a pair of projection pieces 130 is provided on an upper section of the side 123 on the left side in FIG. 26. Shaft sections 131 are provided in locations relative to these projection pieces 130. On the other hand, a finger hook section 133 projecting outward is provided in an upper section of the side 123 on the side opposite thereto, and a hook section 135 is provided on a base side of the finger hook section 133.

The holding member 26 is rotatably combined with the slide member 24 by fitting shaft sections 131 into the bushing 119 of the slide member 24 as previously described. Moreover, the hook section 135 is adapted to be engaged in the aperture 111B formed in one of the erect surfaces 111 of the slide member 24. The hook section 135 is provided such that force forward applied by putting a user's fingertip on the fingertip hook section 133 allows the aperture 111B and the hook section 135 to be disengaged. This holding member is adapted to be rotatable between a first position at which the hook section 135 engages in the aperture 111B to surround the transfer roller 19, and a second position at which the hook section 135 is disengaged from the aperture 111B to release such surrounding of the transfer roller 19. Although not showing, the second position is a position rotated substantially 180° where the side 123 on the side of the shaft sections 131 being provided is in substantially contact with a side of the case 13, and the second position is kept by providing a detent mechanism or the like between the shaft section 131 and the bushing 119.

Figure 3:
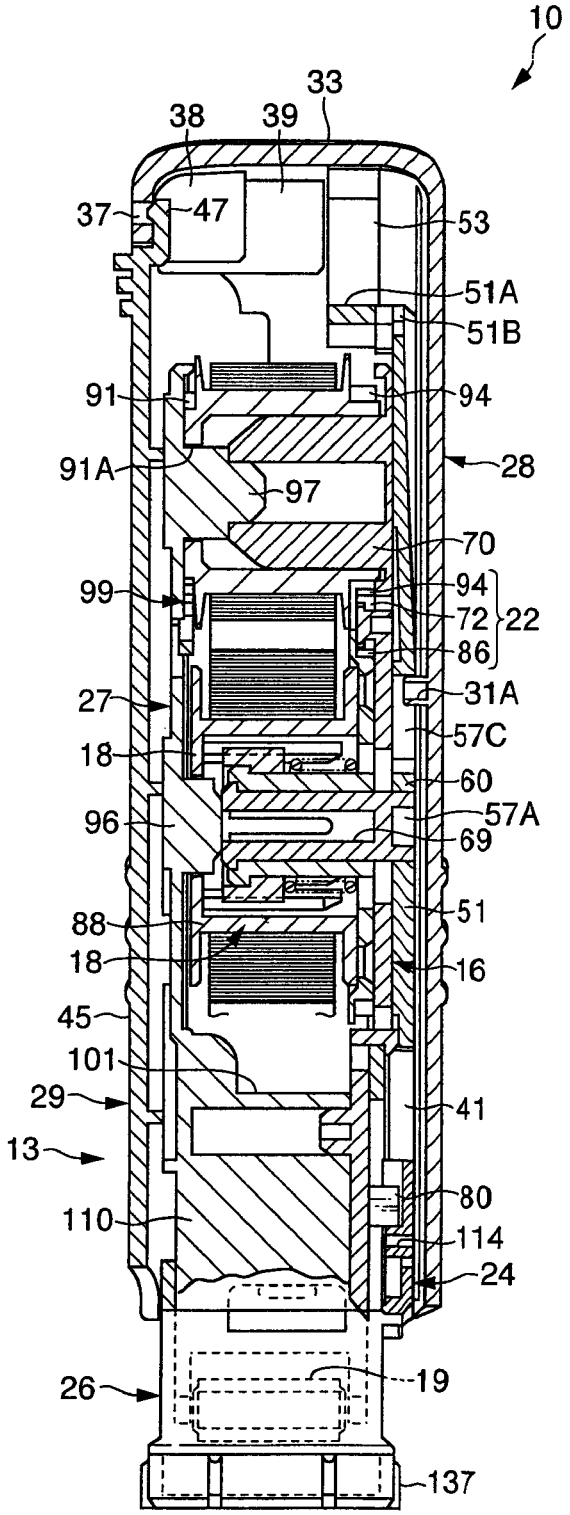
FIG. 3 is a sectional view similar to FIG. 2 in which an external appearance of a holding member is represented.
Figure 4:
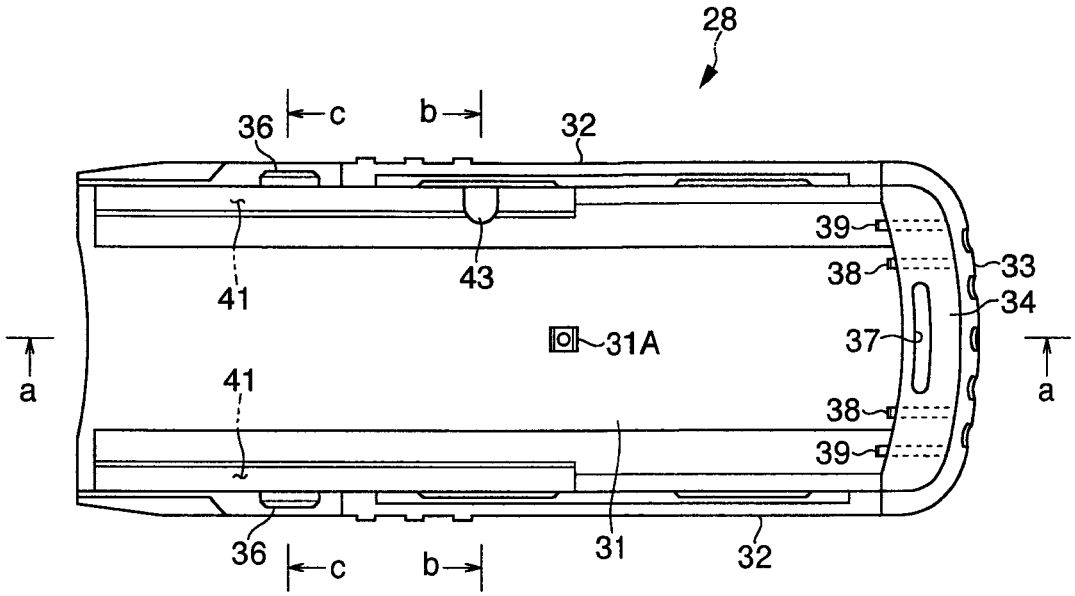
FIG. 4 is a front view of a case body viewed from an inner surface side.
Figure 5:
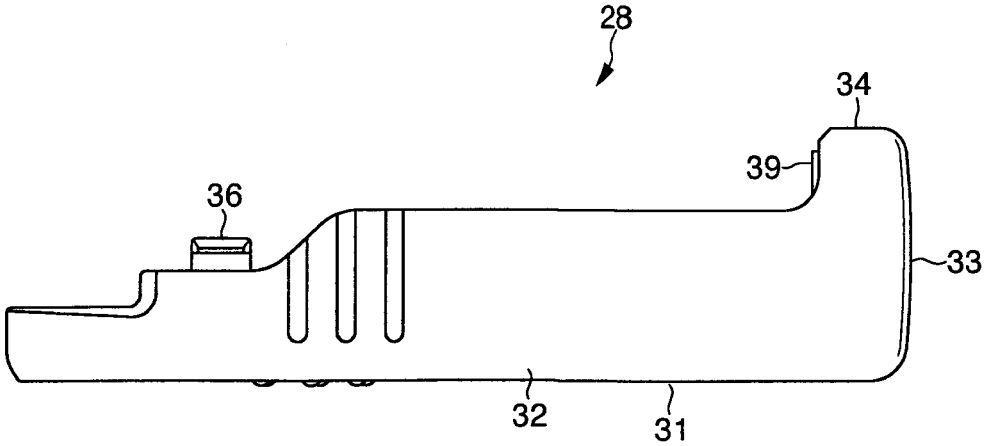
FIG. 5 is a side view of the case body.
Figure 6:
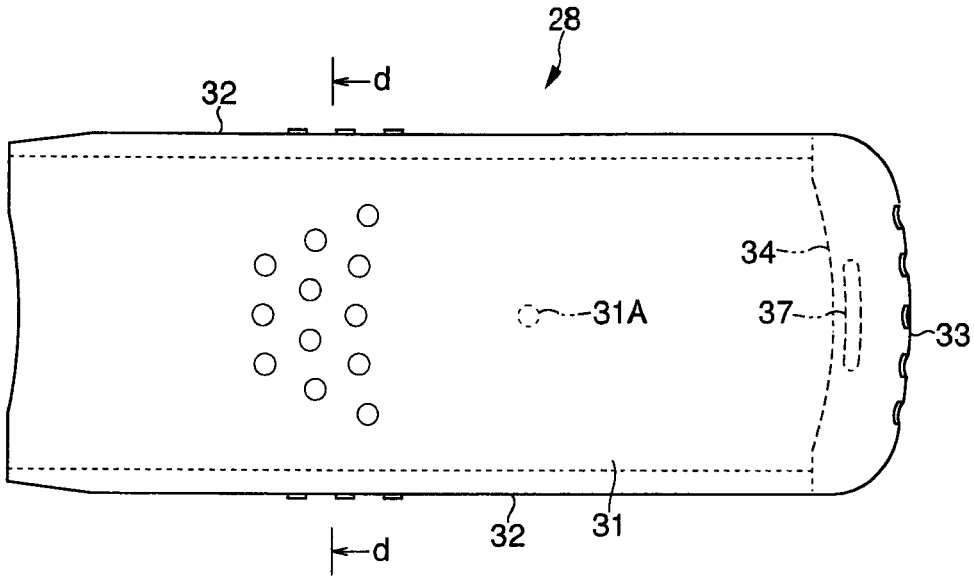
FIG. 6 is a rear view of the case body.
Figure 7:
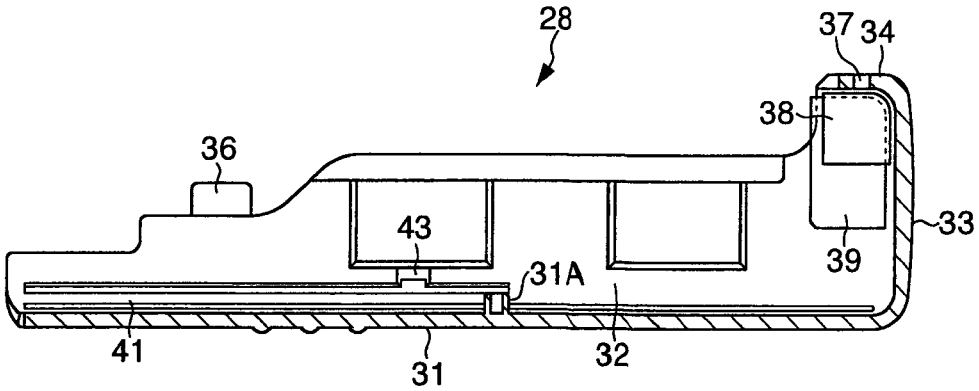
FIG. 7 is a sectional view taken along line a-a of FIG. 4.
Figure 8A:
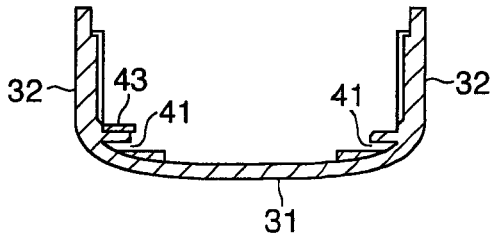
FIG. 8(A) is an end view taken along line b-b of FIG. 4.
Figure 8B:
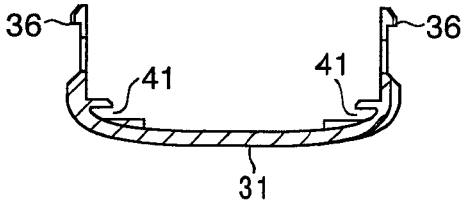
FIG. 8(B) is an end view taken along line c-c of FIG. 4.
Figure 8C:
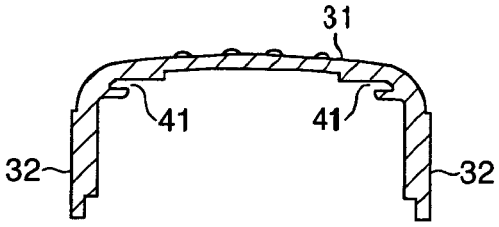
FIG. 8(C) is an end view taken along d-d of FIG. 6.
Figure 9:
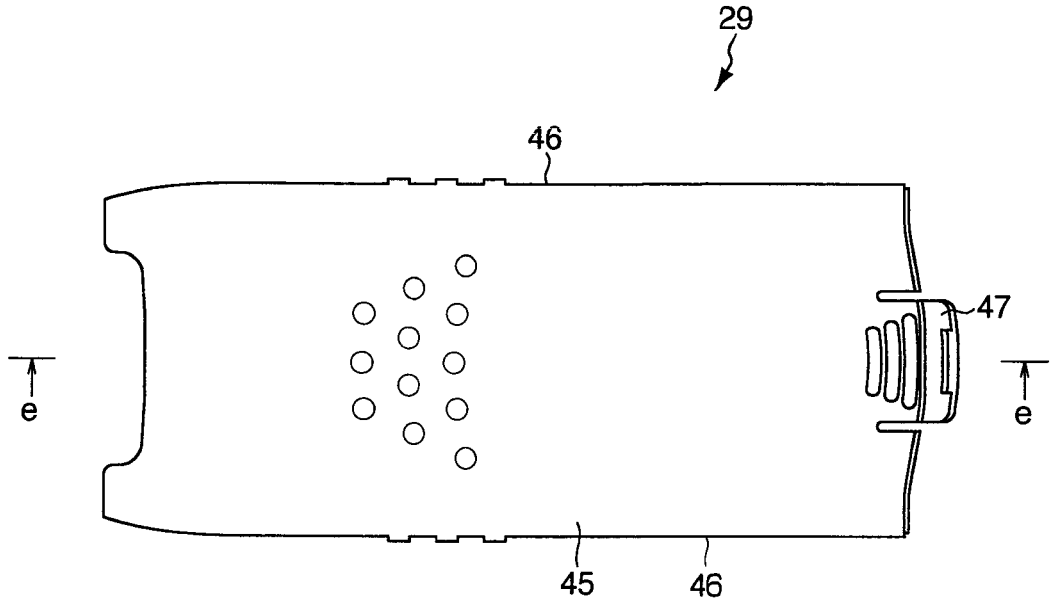
FIG. 9 is a front view of the lid body viewed from an outer surface side.
Figure 10:
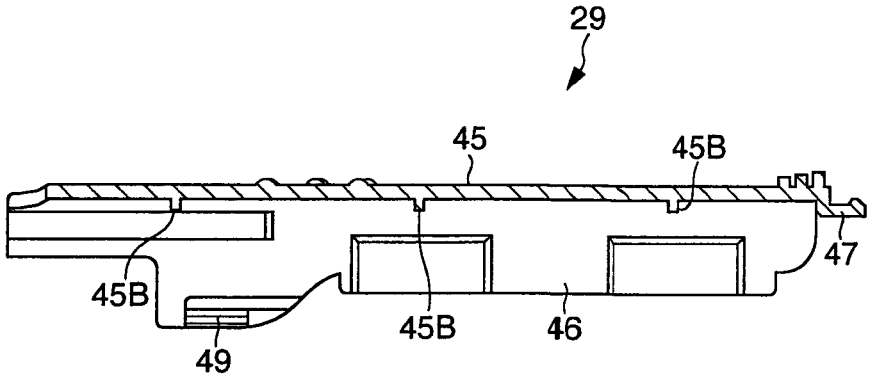
FIG. 10 is a sectional view taken along line e-e of FIG. 9.
Figure 11:
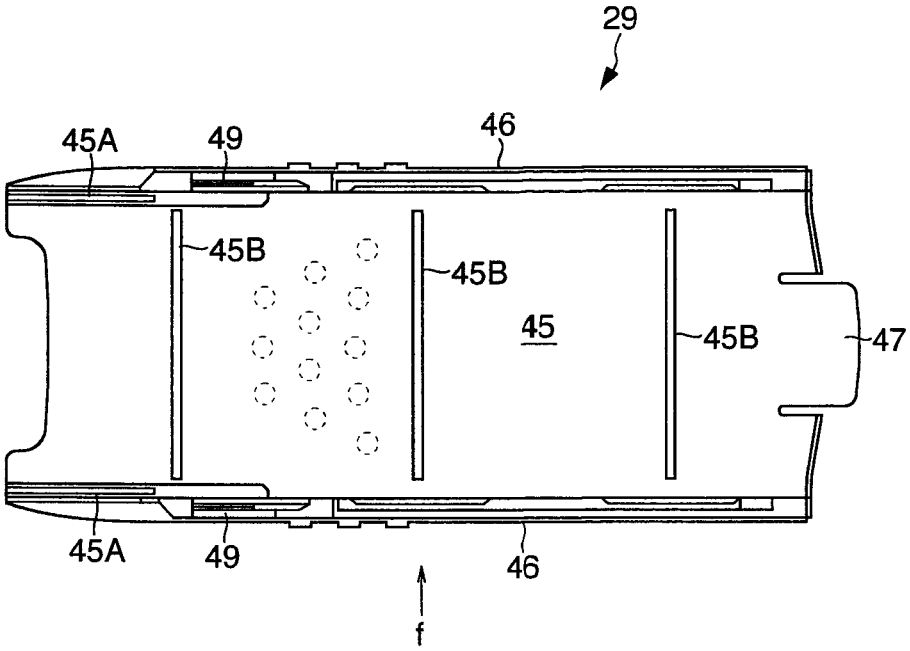
FIG. 11 is a rear view of the lid body viewed from an inner surface side.
Figure 12:
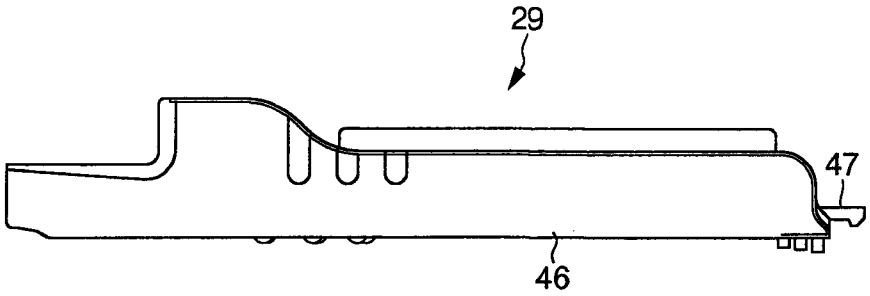
FIG. 12 is a view as viewed from the direction of the arrow f of FIG. 11.

It is noted that, as shown in FIGS. 2 and 3, a closed loop-shaped rubber 137 as a slip preventing member is mounted in a front end section of the holding member 26.

An assembling method of the dispenser 10 is now described, and subsequently transfer operation will be described also with reference to FIG. 30.

As the dispenser 10 is assembled, the cartridge is configured as follows: the feeding roller 18 is supported by the central convex portion 96 of the refill plate 27, while the take-up roller 20 is supported by the rear convex portion 97; the transfer tape T, wound on an outer circumference of the feeding roller 18, is pulled out a predetermined length; and a lead end thereof is fixed to the take-up roller 20 via the transfer roller 19.

First, the main frame 14 and the slide member 24 are combined. This combination is performed by as follows: a rear section of the base surface 110 of the slide member 24 is located on a fore part undersurface side of the main frame 14; and each projection 62 provided on the fore part undersurface side of the main frame 14 is located within the slot 117 of the slide member 24.

The main frame 14 and the slide member 24 combined in this way, which are integral with each other, is placed on an inner surface side of the bottom wall 31 of the case body 28. Thus, the main frame 14 is inserted such that the protruding members 56 located on both sides in a width direction of a back end side thereof are located on a lower end side of the piece members 39, as well as each of piece members 55 provided on both sides in the width direction of the plate-shaped section 51 is located within the guide groove 41 on a case body 28 side. Then, the convex portion 31A, which is provided in a central section of the bottom wall 31, (see FIG. 3) is located within the intermediate punched section 57C located in the central section of the plate-shaped section 51. Thus, the main frame 14 is placed, movably in the front/back direction, on the bottom wall 31 of the case body 28. It is noted that in the main frame 14 being provided in the case body 18, the second spring 53 provided on the back end side thereof is arched with a free end side of the second spring 53 abutting against an inner surface of the back wall 33 of the case body 18, applying force forward to the main frame 14.

While work is performed in which the main frame 14 is placed into the case body 28, the slide member 24 is positioned such that each of the piece shaped sections 118 thereof is located within the guide groove 41 of the case body 28. The slide member 24 is prevented from dropping off forward and comes to be movable in the front/back direction while its floating from the bottom wall 31 of the case body 28 is regulated. With the slide member 24 along with the main frame 14 located within a case body 28, a free end side of the first spring 52 abuts against a back end of the base surface 110 of the slide member 24, thereby always applying forward force to the slide member 24.

With the assembly of the main frame 14 and the slide member 24 completed, the rotational frame 16 is combined therewith on an upper surface side of these main frame 14 and slide member 24. For the rotational frame 16, the projection piece section 67 provided on a back end of the main body surface 65 is inserted into the slot hole 51B located in a rear section of the main frame 14, and the lower end being projected of the first supporting body 69 located in an intermediate section thereof is located within the front punched section 57A which is provided in an intermediate section of the main frame 14. In this case, as shown in FIG. 1, the convex portion 43 formed in the case body 28 is located within the recess 76 formed in an intermediate outer circumference portion of the main body surface 65, thereby maintaining the rotational frame 16 in a position in which a fore part of the rotational frame 16 is tilted nearer a left side of the opening 12. Thus, in the rotational frame 16 being assembled, the downward convex portion 80 provided on an undersurface side of the fore part upper stage surface 66 is located within the closed loop-shaped recess 112 of the slide member 24, the fore part upper stage surface 66 being continuously connected to the fore part of the main body surface 65. In the present embodiment, an initial position is a position where the downward convex portion 80 is located near the upper-left corner in FIG. 1 of the recess 112. It is noted that in the rotational frame 16, the intermediate gear 72 is previously mounted on the protrusion 74 provided on the main body surface 65.

Then, the cylindrical body 82 is mounted on the outer circumferential side of the first supporting body 69 of the rotational frame 16, and the feeding side gear 86 of the flange section 85, located on a lower end side of the cylindrical body 82, is engaged with the intermediate gear 72. Then, the annular member 83 is forcibly fit from above with the coil spring 84 placed on the outer circumferential side of the cylindrical body 82, so that the feeding shaft 68 is configured.

After the rotational frame 16 has been assembled, the cartridge prepared previously may be mounted. This mounting may be performed by locating the feeding shaft 68 within the feeding roller 18 and locating the first supporting body 70 of the rotational frame 16 within the take-up core 90 of the take-up roller 20.

After the cartridge being mounted, the lid body 29 is combined to be connected to the case body 28. The connecting of the lid body 29 is performed as follows: the connection 47 on the back end side of the lid body 29 is engaged in the hole 37 provided in the back upper wall 34 of the case body 28; and each of the claw members 36 on the case body 28 side is engaged in the recess-shaped section 49 formed in the upper side wall 46. This completes the assembly of the dispenser 10.

It is noted that in the lid body 29 being combined with the case body 28, the projecting rim sections 45B provided on an undersurface side (inner surface side) of the planar section 45 in the lid body 29 are located on an upper surface side of the refill plate 27, so that this prevents the refill plate 27 from dropping off.

Figure 30:
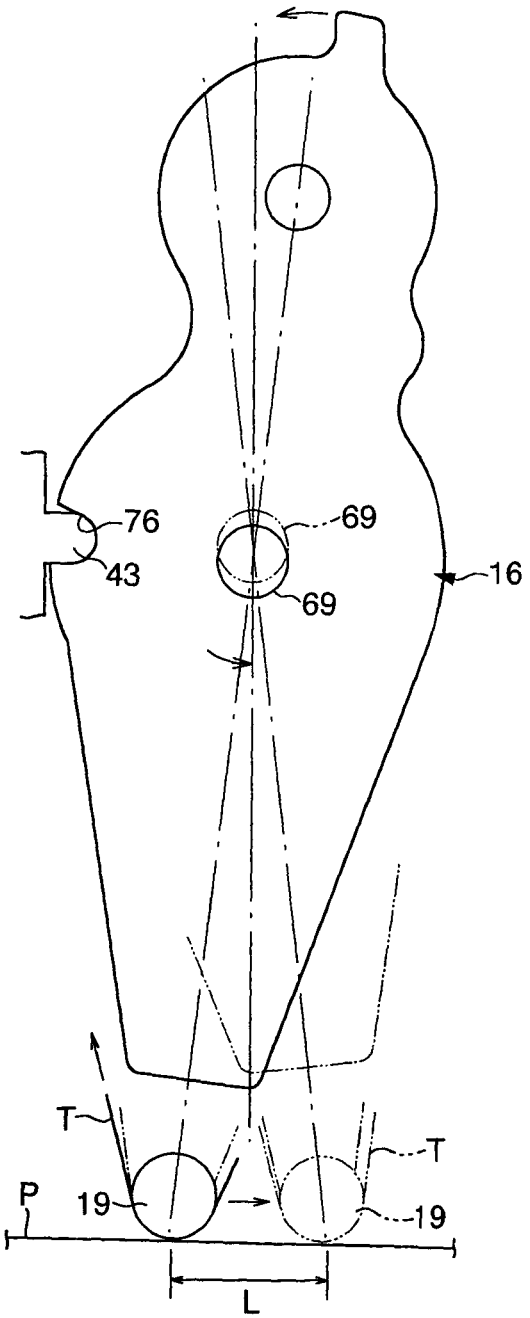
FIG. 30 is an illustrative view showing a principle of rotational motion of the rotational frame.

A method for transferring a transfer agent by using the dispenser 10 will be now described also with reference to FIG. 30.

The dispenser 10 according to the present embodiment may optionally select two aspects: a first aspect of transfer with operational feeling like pressing a rubber stamp; and a second aspect of transfer in which by moving horizontally the case body 10 along the surface P, a transfer agent is transferred into a band shape.

[First Aspect of Transfer]

This transfer is performed with the holding member 26 placed in a first position. Thus, the transfer is performed while the hook section 135 of the holding member 26 is engaged in the aperture 111B of the slide member 24 and the transfer roller 19 is surrounded by the holding member 26.

As shown in FIG. 1, the front end of the holding member 26 abuts against the surface P, and under such condition downward pressing force is applied to the case body 13. When the pressing force is applied thereto, by the bowed rib 127 of the holding member 26 being in contact with the curved surface section 110A located in a front end of the slide member 24, the holding member 26 integral with the slide member 24 move backward to the opening 12 side of the case 13. The slide member 24 is allowed to move back by bowing the first spring 52 to displace the free end side of the first spring 52 in a direction of its backward movement.

When the slide member 24 and the holding member 26 are moved backward, an outer circumference of the transfer roller 19 comes into contact with the surface P. At this time a front end inner edge of each of slots 117 in the slide member 24 abuts against the projection 62 located in a fore part of the main frame 14. Then, further applying a pressing force results in the application of a force causing a backward movement of the main frame 17 (upward movement in FIG. 1).

When the main frame 17 is moved backward, the rotational frame 16 also simultaneously moves backward because the lower end of the first supporting body 69, which is the rotation center of the rotational frame 16, is located within the front punched section 57A. At this time, as shown in FIG. 30, a force reactive to the pressing force rotates the rotational frame 16 in a counterclockwise direction around the position of the convex portion 43 as a supporting point region because the convex portion 43 on the case body 28 side is located within the recess 76 provided in the rotational frame 16. Therefore, the transfer roller 19 may move or travel from a position indicated by solid lines to a position indicated by chain double-dashed lines in FIG. 30, and the rotation of the transfer roller 19 causes the transfer tape T to be fed and taken-up, so that the transfer agent is transferred a distance L long. It is noted that: the transfer roller 19 essentially moves along an arc-shaped trace when the transfer roller 19 moves from the position indicated by solid lines to the position indicated by chain double-dashed lines in FIG. 30; and however in the present embodiment, the force reactive to the pressing force deforms the second spring 53, so that the main frame 14 moves backward, and the refill plate 27 also moves backward via the rotational frame 16 being combined with the main frame 14. Therefore, this allows the transfer roller 19 to be moved along and parallel to the surface P, and does not cause a disadvantage that the movement is prevented.

In this way, when the pressing force is applied to the case 13, the downward convex portion 80 provided in the fore part of the rotational frame 16 moves within the recess 112 of the slide member 24 in a counterclockwise direction in FIG. 1, and when a single transfer operation has been completed, the downward convex portion 80 returns to the initial position described above. In this case, the guide rib 114 is provided in the central section of the recess 112 is provided with, and therefore the movement path of the downward convex portion 80 is constant, and its return movement to the opposite side is also regulated when the downward convex portion 80 passes by the tilted section 114A of the guide rib 114 to the right side, so that its movement in the counterclockwise direction is always assured.

[Second Aspect of Transfer]

In the case of the continuous transferring of the transfer agent along the surface P, the transfer may be performed as follows: the hook section 135 and the aperture 111B are disengaged by putting a fingertip on the finger hook section 133 of the holding member 26; the holding member 26 is rotated clockwise about the shaft section 131 as a rotation center to expose the transfer roller 19; the transfer roller 19 is horizontally moved while pressed against the surface P, similarly to a known dispenser. In this case, the holding member 26 is rotated substantially 180° to maintain a second position at which the side 123 provided with the shaft sections 131 are in contact with a lateral surface of the body case 13. Therefore, this may eliminate a disadvantage that the holding member 26 sways.

Therefore, according to this embodiment, a transfer may be performed with the transfer optionally selected from the following: a discontinuous transfer of the transfer agent with operational feeling like pressing a stamp, or a continuous transfer thereof, which is in a long band shape along the surface.

In addition, in the first aspect of the transfer, the front end of the holding member 26 is only pressed while abutted against the surface P, and therefore the case 13 does not accidentally move along the surface P so that the transfer may be performed in a predetermined area to be transferred.

Moreover, the surface P may be held by the holding member 26. Therefore, this may eliminate a disadvantage that the surface may be lifted up by the transfer agent. In addition, the holding member 26 is prevented from sliding on the surface P because the rubber 137 is mounted on a front end side of the holding member 26.

Although the best configuration, method, and the like for carrying out the present invention have been disclosed in the above description, the present invention is not limited thereto.

Thus, the present invention is particularly illustrated and described mainly in terms of a specific embodiment, but those skilled in the art may made various modifications to the embodiments described above in term of shapes, materials, quantities, or other detailed configurations without deviating from the scope of a technical idea and an object of the present invention.

Accordingly, the description limiting the shapes, materials and the like disclosed above is described as an example in order to facilitate understanding of the present invention, and is not intended to limit the present invention. Therefore, the descriptions of parts name without part or all of the limiting of the shapes, materials and the like are within the present invention.

In the above embodiments, for example, the present invention is configured to rotate and simultaneously displace backward the rotational frame 16, thereby moving the transfer roller 19 horizontally along or parallel to the surface P. However, the present invention is not necessarily intended to be so limited, and may be configured to allow the transfer roller 19 to be moved or traveled in a direction perpendicular to a direction of the pressing force when the holding member 26 is applied by the pressing force while abuts against the surface P.

The shape of the case 13 and dimensions of each part in the above embodiment may be changed depending on the diameter of the feeding roller and the like.

Moreover, means for regulating the rotational direction of the rotational frame 16 is also not intended to be limited to illustrative configuration examples. The rotational frame 16 may have a configuration being rotatable or movable always in a definite direction when the pressing force is applied thereto. Moreover, the position of the convex portion 43 and the recess 76 configuring the regulating means may be interchanged.

Further, the transfer head may use not only the transfer roller, but a head or the like which is piece or plate shaped on its tip side.

The invention claimed is:

1. A dispenser with a transfer head, comprising:

a case provided with an opening in a fore part of the case through which a transfer head faces the outside, the transfer head being comprised of a transfer roller, a feeding roller placed within the case and supporting a transfer tape so as to be capable of being fed, the transfer tape being provided with a transfer agent on a band-like base material tape, a take-up roller for taking up the base material tape, and an interlocking mechanism for rotating the feeding roller and the take-up roller in an interlocking manner, the transfer agent being provided so as to be capable of being transferred via the transfer roller;

a main frame provided within the case movably in the front/back direction of the case, and a rotational frame combined rotatably relative to the main frame, and the feeding roller, the transfer roller, and the take-up roller are provided rotatably in a direction permitting the movement of the transfer roller via the rotational frame, wherein the dispenser is provided with a holding member provided on the opening side of the case so as to be capable of moving forward and backward in a front/back direction, and normally maintaining a front end thereof at a position projecting from the transfer head, wherein when a pressing force is applied to the case in a state of where a front end of the holding member abuts against a surface to be transferred, the transfer roller is relatively projected, and moved or traveled along the surface with pressing thereto so that the transfer agent can be transferred to the surface, wherein the main frame is configured to move backward within the case, and wherein the dispenser is configured such that movement backwards of the main frame allows a rotation center of the rotational frame to be displaced backward, and the main frame comprises a first spring and a second spring having a stronger spring force than the first spring on a front and a back end sides, respectively, the first spring applying a force to the holding member in the direction projecting from the opening, and the second spring applying a force forward to the main frame, wherein the main frame moves backward while overcoming the force of the second spring by a force reactive to the pressing force after the transfer head abuts against the surface, so that the rotation center of the rotational frame is displaced backward to cause the transfer head to be moved along and parallel to the surface.

2. A dispenser with a transfer head, comprising:

a case provided with an opening in a fore part of the case through which a transfer head faces the outside, a feeding roller placed within the case and supporting a transfer tape so as to be capable of being fed, the transfer tape being provided with a transfer agent on a band-like base material tape, a take-up roller for taking up the base material tape, and an interlocking mechanism for rotating the feeding roller and the take-up roller in an interlocking manner, the transfer agent being provided so as to be capable of being transferred via the transfer head;

wherein the dispenser is provided with a holding member provided on the opening side of the case so as to be capable of moving forward and backward in a front/back direction, and normally maintaining a front end thereof at a position projecting from the transfer head, and wherein when a pressing force is applied to the case in a state of where a front end of the holding member abuts against a surface to be transferred, the transfer head is relatively projected, and moved or traveled along the surface with pressing thereto so that the transfer agent can be transferred to the surface, wherein the dispenser further comprises:

a slide member movable in the front/back direction within the case near the opening, the holding member being supported by the slide member, and wherein the slide member comprises a closed loop-shaped recess, and a rotary plate is provided with a convex portion, the convex portion being normally located in place within the recess as an initial position, and guided so as to move within the recess to return to the initial position when the rotary plate is rotated.

* * * * *